United States Patent [19]

Kohl et al.

[11] 4,050,882

[45] Sept. 27, 1977

[54] DUAL VARIABLE ORIFICE FOR REINFORCED PREHEATER

[75] Inventors: Robert F. Kohl, Tucson, Ariz.; Lyle A. Karis, West Allis; James L. Shy, East Troy, both of Wis.

[73] Assignee: Allis-Chalmers Corporation, Milwaukee, Wis.

[21] Appl. No.: 738,847

[22] Filed: Nov. 4, 1976

[51] Int. Cl.[2] ..... F27B 7/02

[52] U.S. Cl. ..... 432/14; 432/16; 432/106; 106/100

[58] Field of Search ..... 432/14, 15, 16, 105, 432/106, 103; 34/57 R, 57 E, 57 A; 106/100, 103

[56] References Cited

U.S. PATENT DOCUMENTS

| | | | |
|---|---|---|---|
| 3,834,860 | 9/1974 | Fukuda et al. | 432/106 |
| 3,869,248 | 3/1975 | Hirai et al. | 432/106 |
| 3,891,382 | 6/1975 | Lawall et al. | 432/106 |
| 3,975,148 | 8/1976 | Fukuda et al. | 432/106 |

*Primary Examiner*—John J. Camby
*Assistant Examiner*—Henry C. Yuen
*Attorney, Agent, or Firm*—Robert C. Jones

[57] ABSTRACT

Variable dual orifices in the restricted portion of the flue between the kiln and the preheater provides a controlled bypass of 0 to 100% of the kiln gases around the preheater and prevents short circuiting of process materials from the precalciner and mixing chamber to the kiln and provides a means for adjusting the orifice and system pressures to thereby provide stability of operation and control over the entire range of bypass; positive isolation of kiln gases from preheater gases during 100 percent bypass operation is ensured.

9 Claims, 2 Drawing Figures

DUAL VARIABLE ORIFICE FOR REINFORCED PREHEATER

BACKGROUND OF THE INVENTION

1. Field of the Invention

This invention relates to apparatus for treating fine granular material such as raw feed material for producing Portland cement. In particular the invention relates to a reinforced suspension preheater arrangement having a flue connection from a kiln to the preheater with means for controlling the flow of kiln gases to the mixing chamber so that 0–100 percent of kiln gases can be bypassed around the preheater and prevent short circuiting of the raw meal to the kiln.

2. Description of the Prior Art

Known apparatus of the prior art that involves preheating finely divided raw material suspended in and moving generally counter to the flow of heated kiln exit gases flowing through one or more cyclone dust separators are disclosed in Czechoslovakian Pat. No. 48,169 of 1934; published German Patent application No. K 156,877 of 1940; U.S. Pat. Nos. 2,648,532 and 2,663,560 of 1953 and many others as identified in U.S. Pat. No. 3,441,258 of 1969.

Apparatus of the aforementioned type but which additionally provide one or more auxiliary burners to additionally heat the feed material after the feed material has been preheated but prior to the feed material entering into the kiln is disclosed in such U.S. Pat. Nos. as: 3,235,239; 3,452,968; 3,507,482; 3,752,455; 3,834,860; 3,843,314; 3,869,248; 3,873,331; 3,881,862; 3,891,382; 3,891,383; 3,904,353; 3,910,754; 3,914,098; 3,925,091; 3,926,651; 3,932,116; 3,932,117 and 3,975,148.

It is known from the prior art and disclosed in U.S. Pat. Nos. 3,869,248; 3,881,862; 3,904,353; 3,910,754 and 3,975,148 that a throttle resistance may be provided within the flue connected to the outlet of the kiln to make use of the suction force of a blower from a first stage cyclone separator to draw hot air from the cooler into the preheater furnace. However, the installation of the fixed throttle resistance has the disadvantage of increasing both the air flow resistance and the power consumption of the suction blower.

In preheater systems, a bypass system is sometimes provided whereby a portion or perhaps all of the kiln gas is extracted from the feed end of the kiln bypassing the preheater. However, in providing a fixed throttle resistance it is necessary to size the throttle such that when there is sufficient vacuum in the preheater, to achieve desired cooler flow, there is not too much kiln flow. The smaller that the throttle resistance is the more assurance there is that it will be possible to achieve the desired cooler flow. If the throttle or orifice is sized smaller than necessary, the kiln and cooler flows are then balanced by partly closing the cooler duct damper. This has the effect of increasing the overall system pressure drop because the throttle or orifice is too small. This increases the power required to operate the preheater fan. The selection of the correct fixed throttle or orifice size is based on estimates such as duct losses etc., thus fixed orifice sizing is based on estimates. In addition, a reinforced suspension preheater system with a bypass and having a requirement to operate at various amounts of bypass, immediately introduces the problem of varying flow through the throttle orifice. This complicates the design of a system to achieve an optimum throttle size since there is more than one design condition. Also, in a reinforced suspension preheater system, the velocity of the gas entering the bottom of the mixing chamber must be sufficient to pick up the material that falls out of the calciner and carry it up to the fourth stage cyclone. If the velocity of the gas entering the bottom of the mixing chamber is not sufficient, the material will fall through the throttle or orifice and enter the kiln thereby bypassing or short circuiting the normal path through the fourth stage cyclone. To maintain sufficient velocity through the throttle during operation at reduced capacity, or during bypass operation, a smaller throttle size may be necessary.

SUMMARY OF THE INVENTION

It is a primary object of the present invention to provide a reinforced suspension preheater arrangement with a dual variable throttle or orifice which permits the size of the throttle to be adjusted during system operation to obtain the optimum size thereby minimizing overall system pressure drop.

In a reinforced suspension preheater system the velocity of the gas entering the bottom of the mixing chamber must be sufficient to pick up the material that falls out of the swirl calciner and carry it to the fourth stage cyclone. This is true because if the velocity of the gas entering the bottom of the mixing chamber is not sufficient, the fallout material will fall through and enter the kiln bypassing the normal path through the cyclones. To maintain a sufficient gas velocity in the system during operation at reduced capacity or during a bypass operation, the size of the throttle throat may require a change. This is especially true when the percentage of bypass kiln gas increases. As the percentage of bypass kiln gas approaches 100%, the flow of gas entering the bottom of the mixing chamber approaches zero as does its velocity. To alleviate this problem there is provided a branch duct which is located above the first or lower adjustable orifice whereby a portion of recoup cooler gas flow can be directed to the throttle area to compensate for the loss of kiln gas flow due to a bypass operation. Also, total flow of recoup cooler gas increases as the amount of kiln gas that is bypassed increases, since more fuel must be burnt in the calciner to compensate for the heat lost due to the increase in the bypassed kiln gas. By providing a recoup cooler gas branch duct at the throttle area, an additional advantage is obtained of permitting recoup cooler gas flow as combustion air to the calciner to remain constant as bypass gas from the kiln increases since extra air is introduced through the branch duct at the throttle area. A second or upper adjustable orifice is located above the recoup cooler gas branch duct and below the bottom entrance of the mixing chamber. This second adjustable orifice makes it possible to control the velocity of the recoup cooler gas from the branch duct as it enters the mixing chamber. Thus, at high bypass conditions the velocity of the gas entering the mixing chamber becomes too low. When this condition occurs, the upper or second adjustable orifice can be reset to increase the velocity of the gas flowing into the mixing chamber. With this arrangement it is possible to operate the system at 100 percent bypass without experiencing material fallout and clogging of the system.

DESCRIPTION OF THE PREFERRED EMBODIMENT

Figure 1:
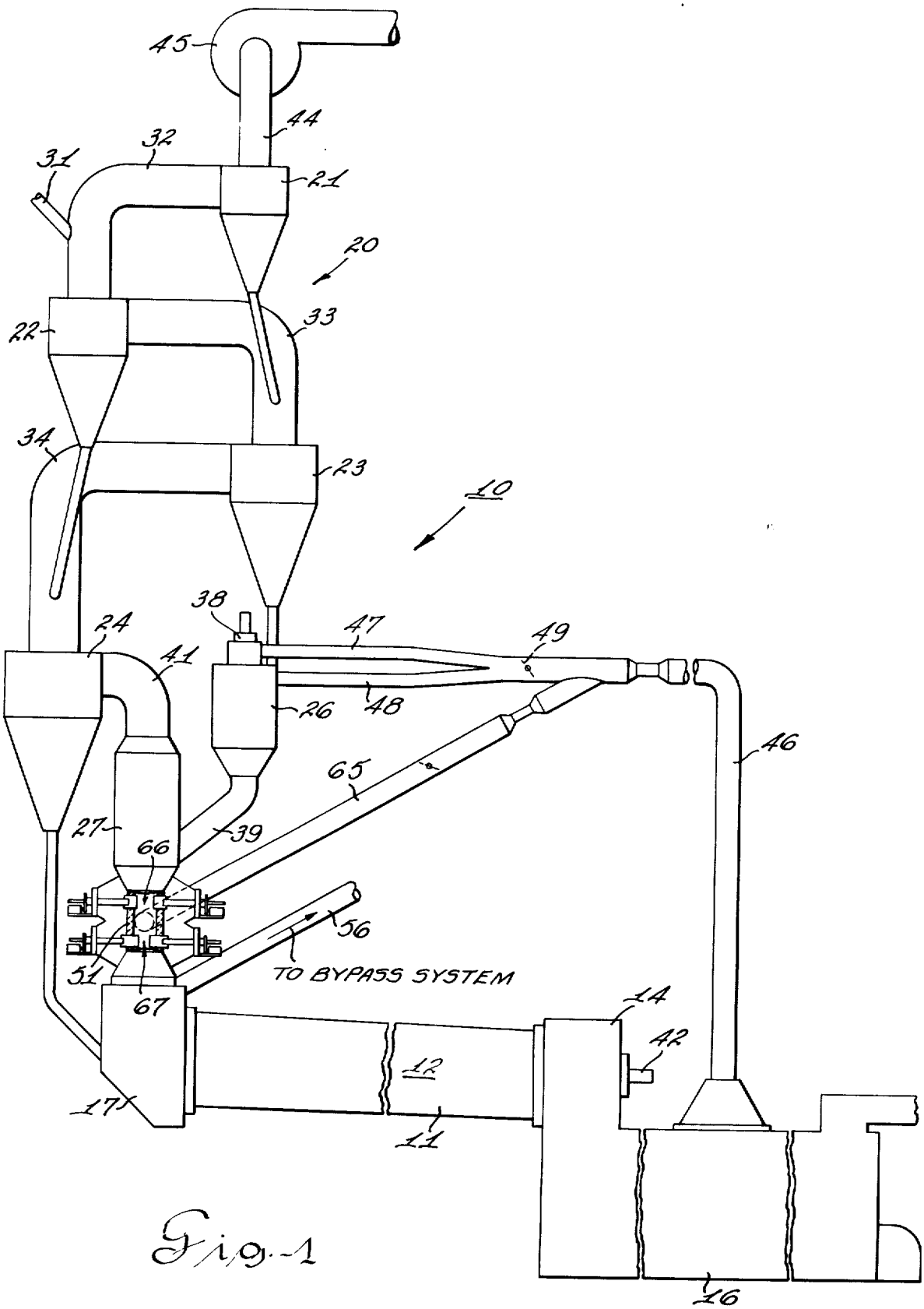
FIG. 1 is a diagrammatic illustration of a reinforced preheater material processing system incorporating the features of the present invention; and, FIG. 2 is an enlarged detailed view of the dual adjustable orifice.

As shown in FIG. 1, the apparatus 10 for processing material for producing a Portland cement, includes a rotary kiln 11 which defines a combustion zone 12. The right end of the kiln 11 leads into a chute 14 which directs clinker from the kiln into a cooler 16. The left or inlet end of the kiln 11 is encompassed by a hood 17 which communicates with a preheater section 20. The preheater section 20 includes a plurality of serially connected cyclones 21, 22, 23 and 24, a calciner 26 and a mixing chamber 27.

Raw meal for processing is fed into the system 10 via an inlet 31 communicating with an exhaust duct 32. The raw meal is heated by the gases flowing from the cyclone 22 and collected in the cyclone 21 and dropped into the duct 33. The raw meal is transferred from the exhaust duct 33, the cyclone 22, and the duct 34 to the cyclone 23. This transfer of the raw meal ensures sufficient peheating of the meal material before it is charged into the calciner furnance 26. In the calciner, calcining reaction of the meal material is accomplished by the heat obtained by burning fuel from a burner 38. The calcined material is discharged through a duct 39 into the mixing chamber 27 together with the exhaust gases where it mixes with upsweeping gases from the kiln 11. This mixture of gases and calcined material is carried into duct 41 and thence into cyclone 24. From the cyclone the material is charged into the rotary kiln 11 and is burnt by the heat supplied by burner 42. The processed clinker is cooled in cooler 16.

The exhaust gases from the system setforth are discharged through a duct 44 being drawn from the system by operation of a exhaust fan 45. The hot gases from cooler 16 are recouped and introduced to the calciner as combustion air for the burner 38 by means of duct 46 and first secondary duct 47. Recoup air is also introduced into the calciner 26 as heat by means of another second secondary duct 48. A damper 49 in duct 46 is operable to control the volume of the recoup gases passed to the calciner 26.

In the arrangement so far described, the balance of kiln flow and cooler flow is obtained through use of a restricted portion of duct 51 and the damper 49. The restricted portion of duct 51 also serves to increase the velocity of the gas from the kiln to the entrance of the mixing chamber 27 to ensure that material dropout from the mixing chamber 27 does not occur.

In processing material in which the alkali level is high, through the system setforth, bypass systems are often employed to reduce alkali levels in the product and/or eliminate plugging problems in the preheater. In this case, a certain portion of kiln gas is lost to the bypass system 56 which is compensated for by the addition of recoup cooler through a recoup cooler branch duct 65. The branch duct 65 is tapped off the recoup duct 46 upstream of the first and second secondary ducts 47 and 48. Thus, the flow of recoup cooler gas is divided between the first and second secondary ducts 47 and 48 and the branch duct 65. With this arrangement, some of the gas lost through the bypass system 55 is replaced. Since some of the heat from the kiln to the preheater 20 is also lost to the bypass system, additional fuel must be supplied by the burner 38. As a result, additional combustion air must be supplied to the additional fuel that is added to the calciner as a result of the heat lost to the bypass system.

In a reinforced suspension preheater system 10 in which a bypass system 55 is included to effect a reduction of alkali in the clinker, a portion or all of the kiln gas is directed from the feed end of the kiln and diverted from the preheater 20. In the present arrangement, secondary air from the cooler 16 is directed via duct 46 to the swirl calciner. This occurs because the pressure is lower in the swirl calciner than it is in the cooler. The damper 49 controls the amount of air flow. However, when the damper 49 is fully open, the amount of air flow is limited by the vacuum available in the calciner. Since the kiln 11 forms a parallel flow path from the cooler to the preheater 20, the kiln gas and the recoup cooler gas meet in the mixing chamber 27 of the preheater. However, the amount of gas flowing from the cooler 16 to the preheater 20 through the kiln 11 must also be controlled. To obtain the desired flows through both the kiln 11 and the recoup duct 46, the reduced flue section 51 must be correctly sized. The sizing of the reduced flue portion is usually based on the designer's experience and once the fixed geometry is picked and built, the system is saddled with the design and change can only be accomplished by tearing the flue down and rebuilding it.

In the reinforced suspension system, herein illustrated, the velocity of the gas entering the bottom of the mixing chamber 27 must be sufficient to pick-up the material that falls out of the swirl calciner and carry it to the fourth stage cyclone 24. If the velocity is not sufficient, the material will fall through the reduced flue portion 51 and enter the kiln thereby bypassing the normal process flow path through the fourth stage cyclone 24. To maintain sufficient velocity at this point in the system during operation at reduced capacity or during bypass operation, the reduced flue portion must be smaller.

As the percent of bypass increases from 50 percent to 100 percent, the flow of kiln gas entering the bottom of the mixing chamber approaches zero as does the flow velocity. To alleviate this problem it is proposed to construct the reduced flue portion 51 with two variable orifices, an upper variable orifice 66 and a lower variable orifice 67 with a recoup cooler branch duct 65 communicating with the flue 51 in the area between the two variable orifices. With this arrangement a portion of the recoup cooler gas flow can be brought to the orifice area to compensate for the loss of kiln gas flow. Total recoup cooler gas flow through branch duct 65 increases as the percent of bypass increases since more fuel is burned in the calciner to replace kiln gas heat loss to the bypass. In addition, the recoup cooler branch duct 65 permits flow to the calciner to remain constant as bypass increases since the extra recoup flow is introduced through the branch duct 65.

At high bypass conditions the flow of recoup cooler gas through the branch duct 65 is such that the velocity of the flow entering into the mixing chamber becomes too low. Thus, the upper variable orifice 66 may be adjusted to reduce the dimension of the orifice to increase the velocity of the flow as required.

With the recoup cooler branch duct 65 and the upper variable orifice 66 and the lower variable orifice 67, it is possible to operate the reinforced suspension system 10 at 100 percent bypass which heretofore has not been possible.

Figure 2:
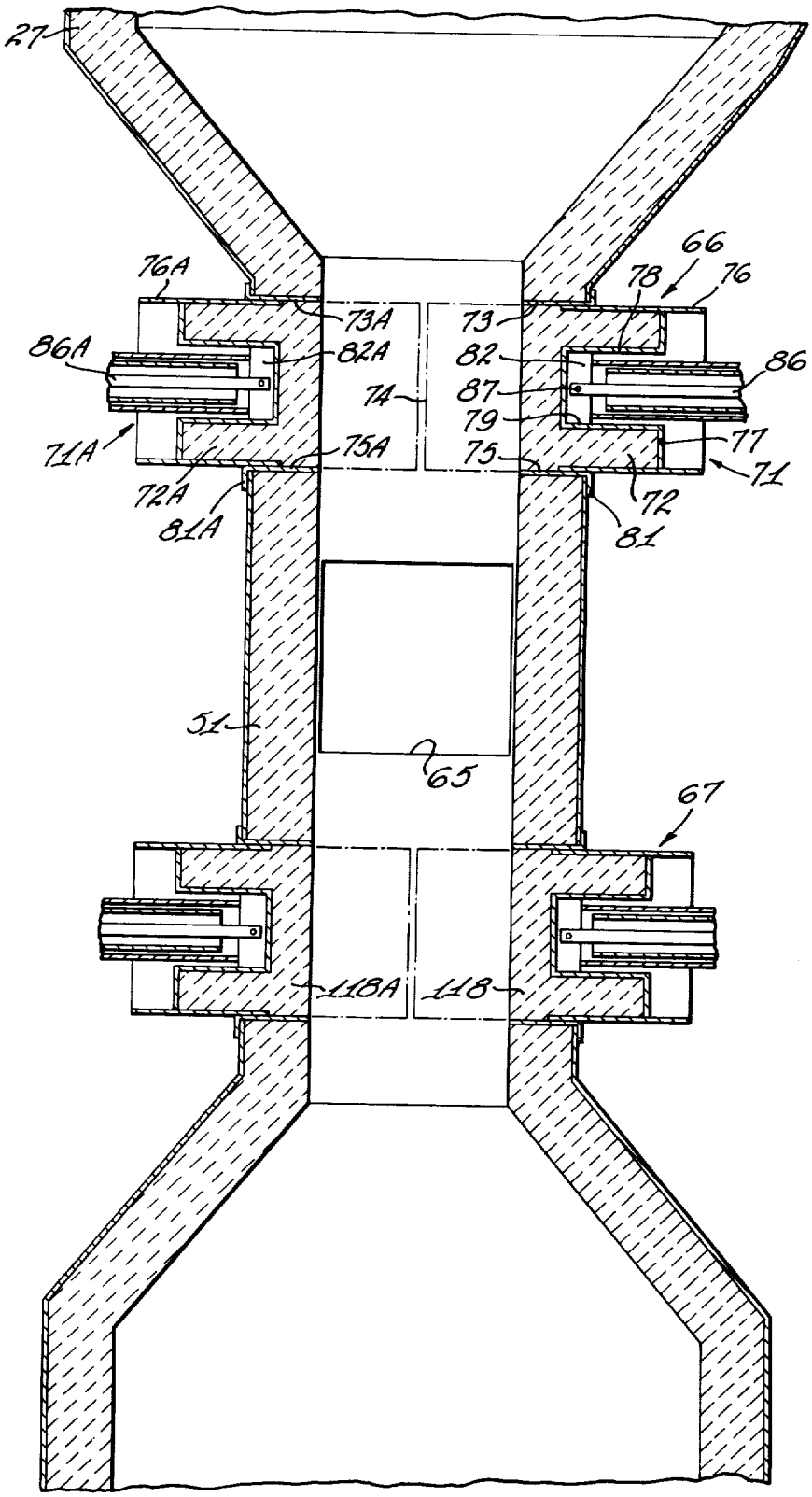

The variable orifices 66 and 67 are identical and therefore a description of the orifice 66 will also apply to the orifice 67. As shown in FIG. 2, the restricted flue portion 51 is of substantially square configuration in cross-section and, of course, lined with heat resistant material. Below the mid-area of the flue portion 51 wherein the recoup cooler branch duct 65 enters, the lower variable orifice 67 is operably disposed. The variable orifice 66 is constructed as a two-part arrangement 71–71A which reduces the in-and-out travel of each part to one-half the distance of the total dimension of the flue 65. However, if so desired, the orifice could be made as a single unit with travel across the entire flue space. Each part 71 and 71A of the variable orifice 66 are identical, thus, a description of the part 71 will also apply to the part 71A. The movable orifice part 71 includes an insulated block 72 which is movably disposed within a suitable opening 73 formed in the flue portion 51. The block 72 is shown in a fully open position and is movable therefrom to a centered fully closed position of the flue portion 51 represented by the dash and dot line 74 where it will abut the other block 72A of the portion 71A. A metallic liner 75 within the opening 73 supports the block 72 for sliding movement. A shield 76 surrounds the outer-extending end of the block 72 and serves to protect the extending end of the block 72 from damage when in its fully open position as depicted. The shield 76 includes an insert 77 having an extension 78 that is received within a centrally located recess 79 formed in the outerface of the block 72. A rectangular seal member 81 encompasses the extending outer end of the block 72 and operates to seal the joint spaces between the block and the flue. A vertical web 82 firmly secured within the extension 78 provides an anchoring point for a rod 86. The rod 86 is formed with a bifrucated end which engages on both sides of the web 82 and is secured in position by means of a pin 87.

The embodiments of the invention in which an exclusive property or privilege is claimed are defined as follows:

1. In a method of processing cement materials for making Portland cement in a system utilizing kiln and an associated cooler and having a flue connection to a suspension preheater provided with a calciner and a mixing chamber, wherein the material to be processed is suspended in a gas stream, comprising the steps of:

A. Regulating the amount of kiln off-gases that is permitted to pass into the mixing chamber;

B. Bypassing the kiln off-gases not passed to the mixing chamber through a bypass system;

C. Supplying gas from a source to replace a portion of the kiln off-gases not passed to the mixing chamber;

D. Regulating the flow of the gas supplied from the source and off-gases from the kiln and the flow area to the mixing chamber to control the flow velocity of the gases into the mixing chamber thereby preventing materials in the mixing chamber from short circuiting and preheater system by falling out into the kiln.

2. The method of processing cement materials according to claim 1 wherein the supply of gas of step C is obtained from the cooler as recoup gas and is supplied to the flue connection between the kiln and the suspension preheater.

3. The method of processing cement materials according to claim 2 wherein regulation of the amount of kiln off-gases permitted to pass to the mixing chamber of step A is accomplished by adjusted gas flow passage in the connection to reduce the cross-sectional area thereof below the position where the recoup cooler gas enters the connection.

4. The method of processing cement materials according to claim 3 wherein the regulation of the velocity of gases to step D passing into the mixing chamber is accomplished by adjusting the gas flow passage in the connection above the location where the recoup cooler gases enter the connection and below the entrance to the mixing chamber.

5. The method of processing cement materials according to claim 4 where regulation of step D accomplished by adjusting the cross-sectional area of the gas flow passage is over a full range of bypass flow from full bypass flow to no bypass flow.

6. The method of processing cement materials according to claim 3 wherein the adjusting of the gas flow passage in the connection below the location where recoup cooler gases enter the connection can be accomplished from full gas flow to no gas flow selectively.

7. In a method of processing fine granular materials in a system utilizing a kiln and an associated cooler and having a flue connection to a suspension preheater provided with a furnace chamber in which fuel is introduced and burned and wherein the material to be processed is suspended in a gas stream, comprising the steps of:

A. Regulating the amount of kiln off-gases that is permitted to pass into the suspension preheater;

B. Bypassing the kiln off-gases not passed to the suspension preheater through a bypass system;

C. Supplying gas from a source to replace a portion of the kiln off-gases not passed to the suspension preheater;

D. Regulating the flow of the gas supplied from the source and off-gases from the kiln and the flow area at the entrance to the suspension preheater to control the flow velocity of the gases into the suspension preheater thereby preventing materials in the suspension preheater from short circuiting the normal material path through the preheater system by falling out into the kiln.

8. In a method of processing cement materials for making cement in a system utilizing kiln and an associated cooler and having a flue connection to a suspension preheater provided with a calciner wherein the material to be processed is suspended in a gas stream, comprising the steps of:

A. Regulating the amount of kiln off-gases that is permitted to pass into the calciner;

B. Bypassing the kiln off-gases not passed to the calciner through a bypass system;

C. Supplying gas from a source to replace a portion of the kiln off-gases not passed to the calciner;

D. Regulating the flow of the gas supplied from the source and off-gases from the kiln and the flow area at the entrance to the calciner to control the flow velocity of the gases into the calciner thereby preventing materials in the calciner from short circuiting the preheater system by falling out into the kiln.

9. An apparatus for processing cement materials for making Portland cement which utilizes a kiln having an inlet end enclosed in a hood and an outlet end connected to an associated cooler and having a reinforced preheater system provided with a calciner and a mixing chamber which receives calcined material from the calciner to mix with gas supplied to the mixing chamber, the improvement including;

a gas flow flue connected between the kiln hood and the entrance to the mixing chamber;

a kiln off-gas bypass means connected into the kiln hood and operable to provide a bypass flow path for kiln off-gases;

a first selectively adjustable flue restricting means operably disposed in said flue to restrict the flow of kiln off-gases into said flue;

a duct operatively connected between a source of recoup cool gas and said flue to direct recoup gas into said flue; and, a second selectively adjustable flue restricting means operably disposed in said flue in a position above the entrance of said recoup cooler gas duct into said flue;

whereby the first adjustable flue restricting means may be selectively operated to restrict the flow of a predetermined amount of kiln off-gases into said flue thereby forcing the kiln off-gases to flow into the bypass path, and said recoup cooler gas branch duct operates to provide a volume of recoup gas to supplement the kiln gas that is bypassed, and the second adjustable restricting means is selectively operable to restrict the flue opening therethrough to effect an increase in the velocity of the gas flowing into the mixing chamber thereby preventing materials from falling out of the mixing chamber.

* * * * *